US010376943B1

(12) United States Patent
Yuan

(10) Patent No.: US 10,376,943 B1
(45) Date of Patent: Aug. 13, 2019

(54) FROZEN FORMING METHOD FOR LARGE TAILORED PLATE ALUMINUM ALLOY COMPONENT

(71) Applicant: Shijian Yuan, Harbin (CN)

(72) Inventor: Shijian Yuan, Harbin (CN)

( * ) Notice: Subject to any disclaimer, the term of this patent is extended or adjusted under 35 U.S.C. 154(b) by 0 days.

(21) Appl. No.: 16/234,371

(22) Filed: Dec. 27, 2018

Related U.S. Application Data

(63) Continuation of application No. PCT/CN2018/000188, filed on May 23, 2018.

(30) Foreign Application Priority Data

Feb. 8, 2018 (CN) ..... 2018 1 0126112

(51) Int. Cl.

| | |
|---|---|
| ***B21D 37/16*** | (2006.01) |
| ***B21D 37/10*** | (2006.01) |
| ***B21D 22/22*** | (2006.01) |
| ***C22F 1/04*** | (2006.01) |

(52) U.S. Cl.
CPC ..... *B21D 37/16* (2013.01); *B21D 22/22* (2013.01); *B21D 37/10* (2013.01); *C22F 1/04* (2013.01)

(58) Field of Classification Search
USPC ..... 148/701
See application file for complete search history.

(56) References Cited

U.S. PATENT DOCUMENTS 4,159,217 A * 6/1979 Selines ..... C22F 1/04 148/577
2013/0312881 A1* 11/2013 Kamp ..... C22C 21/06 148/696

FOREIGN PATENT DOCUMENTS

| | | | | |
|---|---|---|---|---|
| CN | 105397288 | A | | 3/2016 |
| CN | 107159867 | A | | 9/2017 |
| CN | 107199289 | A | * | 9/2017 |
| CN | 107520308 | A | | 12/2017 |
| CN | 107866491 | A | | 4/2018 |
| CN | 103966471 | A | | 8/2018 |
| JP | 06154894 | A | * | 6/1994 |
| JP | 2010227954 | A | | 10/2010 |

* cited by examiner

*Primary Examiner* — Brian D Walck
(74) *Attorney, Agent, or Firm* — Ding Yu Tan

(57) ABSTRACT

A frozen forming method for a large-size thin-walled aluminum alloy component using an aluminum alloy tailor-welded plate is described. An aluminum alloy tailor-welded plate is cooled to a temperature with a cryogenic fluid medium, and temperature of a weld zone is regulated to be lower than that of a base metal zone; and the component is fabricated by a tool integrally with aluminum alloy tailor-welded plate, by placing aluminum alloy tailor-welded plate onto tool; assembling tool and filling with cryogenic fluid medium so temperature of tool is −150 to −196 degrees Celsius; and apply pressure to deform the aluminum alloy tailor-welded plate when temperature of a weld zone reaches −150 degrees Celsius to −196 degrees Celsius, thereby facilitating forming the aluminum alloy tailor-welded plate to a designed shape of the aluminum alloy component; and disassembling the tool, and taking out the aluminum alloy component.

11 Claims, 10 Drawing Sheets

7

7

FROZEN FORMING METHOD FOR LARGE TAILORED PLATE ALUMINUM ALLOY COMPONENT

TECHNICAL FIELD

The present invention relates to the technical field of sheet metal forming, and in particular to a forming method at cryogenic temperature for a large-size component using an aluminum alloy tailor-welded plate.

BACKGROUND ART

Aluminum alloy, featuring excellent specific strength, specific stiffness and corrosion resistance, has been one of primary structural materials for aerospace equipment such as a rocket and an aircraft. The aluminum alloy accounts for about 80% of the structural mass of a carrier rocket and above 50% of the structural mass of a civil aircraft. With the development of a new generation of large rockets and aircrafts, an urgent need emerges for large-sized integral structure comprising aluminum alloy thin-walled components to meet their requirements for higher reliability, longer lifespan and lighter weight.

An existing technical roadmap for manufacturing aluminum alloy thin-walled component was presented as "sheet metal forming separately, welding into an integral component and heat treatment for property control" in one prior art literature. The prior art has the main problems that a relatively high degree of distortion is caused after welding, and an even greater distortion is caused after the heat treatment. What's more, the integral thin-walled component can't be subjected to shape correction after forming and welding, and the prior art method usually leads to lower precision and a failure to meet the use requirements. In order to solve the problems above, a technical roadmap to be adopted is "sheet metal tailor-welding for preparing a large-size tailor-welded plate, heat treatment for property control and integral forming using the large-size tailor-welded plate for a large-size thin-walled component". For the advantage of high strength coefficient of weld joint, friction stir welding (FSW) has become a preferred welding method for aluminum alloy components in the aerospace field in recent years, instead of fusion welding methods such as arc welding and laser welding. Therefore, there is an urgent need for development of a large-size integral component forming technology using aluminum alloy FSW tailor-welded plate.

However, there are some insuperable difficulties for forming the larger-sized aluminum alloy thin-walled integral component by an existing conventional cold forming (forming at room temperature) technology and a hot forming (forming at elevated temperature) technology. As to the cold forming technology, a larger-sized thin-walled tailor blank is prone to wrinkle and a FSW weld joint is prone to crack when a conventional deep drawing technique is adopted, thus both the wrinkling and cracking defects exist and can't be overcome. Sheet hydroforming has been looked as a promising cold forming technology for large-size thin-walled component with curved surface. However, the forming force of a component with the diameter of 5 m reaches 800 MN, and the cost and risk of super-large fluid high pressure forming equipment are extremely high when sheet hydroforming technique is adopted. As to the hot forming technology, the FSW weld joint is softened in heating status, and the cracking problem can't be solved for the lower strength caused by softened weld joint in the forming process. Furthermore, there are very difficult to control the microstructure and mechanical properties of the formed component in the hot forming process.

In order to solve the problems when the larger-sized aluminum alloy integral thin-walled component is manufactured with the traditional forming technologies, a method called frozen forming technology is invented for forming of larger-sized aluminum alloy tailor-welded component at very low temperature by utilizing a new phenomenon that the aluminum alloy sheet is enhanced both on plasticity and strength at a very low temperature as described herein below.

SUMMARY OF THE INVENTION

The present invention provides a frozen forming method for an aluminum alloy tailor-welded component to overcome the defects in the prior art aluminum alloy components fabricated. An embodiment of the present invention is as follows: the frozen forming method includes steps of cooling an aluminum alloy tailor-welded plate to a temperature within an appropriate very low temperature range with a cryogenic fluid medium, and forming the aluminum alloy tailor-welded component with a set of tool (the tool is usually comprised by a punch, a die and a blank-holder, and so on), and particularly includes the following steps of:

step 1, the aluminum alloy tailor-welded plate prepared by FSW is placed onto the tool;

step 2, the tool is assembled and the tool is filled with the cryogenic fluid medium so that the temperature of the tool drops to −150 degrees Celsius to −196 degrees Celsius;

step 3, the punch of the tool is allowed to apply pressure on the aluminum alloy tailor-welded plate when the temperature of a weld zone of the aluminum alloy tailor-welded plate reaches −150 degrees Celsius to −196 degrees Celsius and the temperature of the weld zone is lower than the temperature of a base metal zone, that is a temperature difference delta T occurs between the weld zone and the base metal zone, thereby the aluminum alloy tailor-welded component is deformed; and step 4, the tool assembled in step 2 is disassembled in this step, and the aluminum alloy tailor-welded component is taken out, thereby it is completed for the frozen forming of the aluminum alloy tailor-welded component.

Preferably, in the step 3 the temperature difference between the weld zone and the base metal zone is not less than 30 degrees Celsius.

Preferably, the aluminum alloy tailor-welded plate is one of an Al—Cu—Mg alloy plate, an Al—Cu—Mn alloy plate, an Al—Mg—Si alloy plate, an Al—Zn—Mg—Cu alloy plate and an Al—Cu—Li alloy plate.

Preferably, the large-size aluminum alloy tailor-welded plate is prepared by a friction stir welding technology.

Preferably, the cryogenic fluid medium is a cooling medium for low temperature, and is, for example, either liquid nitrogen or liquid helium.

Preferably, solution treatment is conducted on the aluminum alloy tailor-welded plate before the step 1, and artificial aging treatment is conducted on the aluminum alloy tailor-welded component after the step 4.

Preferably, the tool comprises at least one cooling chamber, and the cooling chamber is disposed at a portion, where the weld zone is located, in the tool, and is used for cooling.

Preferably, in the step 2, the temperature of the tool is regulated through a control device, and the control device is connected with the cooling chamber, and the temperature of the cooling chamber is further controlled by regulating the flow of the cryogenic fluid medium.

Preferably, the tool is further provided with cold insulation and preservation layers.

Preferably, the tool is provided with a cooling channel, and the cooling channel is disposed below the aluminum alloy tailor-welded plate.

Compared with the prior art, the present invention has some beneficial effects which include the following aspects: 1) The cracking problem caused by a high degree of deformation in the weld zone can be avoided by utilizing the feature that the plasticity and the strength of the weld zone are higher than the plasticity and the strength of the base metal zone, which is caused by the temperature difference on the aluminum alloy tailor-welded plate at cryogenic temperature; 2) The microstructure damages can be avoided and restored to original microstructure status after forming of aluminum alloy tailor-welded component by the frozen forming method. As a result, the microstructure and mechanical properties of the aluminum alloy tailor-welded component are minimally changed by the forming at the cryogenic temperature range; and 3) Frozen lubricating layers are formed at working surfaces between the tailor-welded plate and the tool, which can reduce friction force and forming force during flowing of the plate, as well as the tonnage and cost of forming equipment.

BRIEF DESCRIPTION OF THE DRAWINGS

In order to more clearly illustrate the technical schemes in embodiments of the present invention, the drawings to be used in the embodiments will be simply introduced as follows.

DETAILED DESCRIPTION OF THE INVENTION

The above-mentioned and other technical features and advantages of the present invention will be further described in detail below in conjunction with the accompanying drawings.

Figure 1:
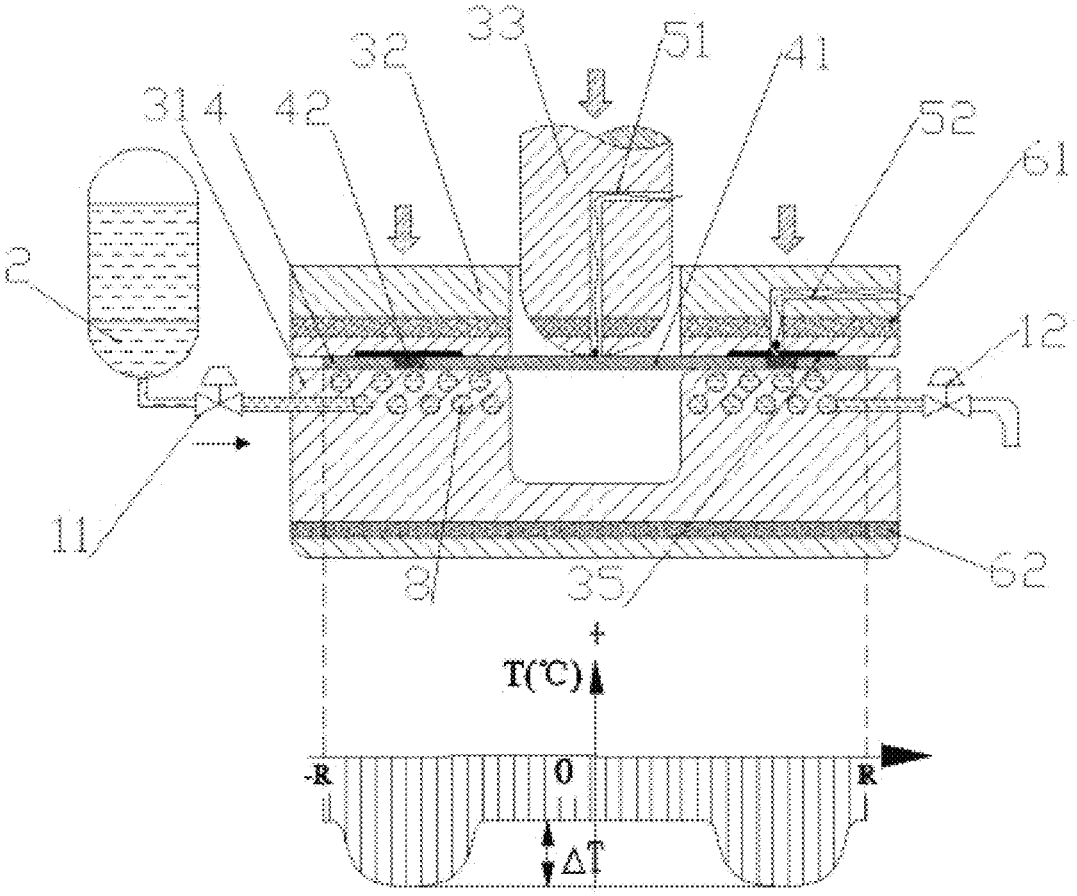
FIG. 1 is a schematic diagram of initial status/setup of frozen forming using an aluminum alloy FSW tailor-welded plate, where a tool is provided with a cooling channel, according to an embodiment of the present invention.

Please refer to FIG. 1. FIG. 1 is a schematic diagram of initial status, or setup of cryogenic/freezing forming using an aluminum alloy friction stir welding (FSW) tailor-welded plate, where a tool is provided with a cooling channel, according to an embodiment of the present invention.

The present invention provides a first embodiment of a frozen forming method for an aluminum alloy tailor-welded component structure. An aluminum alloy tailor-welded plate 4 is prepared by friction stir welding (FSW) technology. The frozen forming method according to a first embodiment of the present invention is as follows: the aluminum alloy tailor-welded plate 4 is cooled to a temperature within an appropriate very low temperature range with a cryogenic fluid medium, and a aluminum alloy tailor-welded flat bottom cylindrical component 7 is formed by a tool. For the sake of simplicity, the aluminum alloy tailor-welded flat bottom cylindrical component 7 is also referred to as the aluminum alloy tailor-welded component 7 in the following descriptions.

The additional/further specific steps for the frozen forming method in example 1 are as follows in these steps: step 1, the aluminum alloy tailor-welded plate is placed onto the tool;

step 2, the tool is assembled and filled with the cryogenic fluid medium so that the temperature of the tool drops to −150 degrees Celsius to −196 degrees Celsius; step 3, the tool is allowed to apply pressure to deform the aluminum alloy tailor-welded plate when the temperature of a weld zone 42 of the aluminum alloy tailor-welded plate reaches −150 degrees Celsius to −196 degrees Celsius and the temperature of the weld zone 42 is lower than the temperature of a base metal zone 41, that is a temperature difference delta T occurs between the weld zone 42 and the base metal zone 41, thereby forming the aluminum alloy tailor-welded component 7; and step 4, the tool assembled in the step 2 is now disassembled, and the aluminum alloy tailor-welded component 7 is taken out, thereby completing the frozen forming of the aluminum alloy tailor-welded component 7.

The frozen forming method for the large-size aluminum alloy tailor-welded component involves a frozen forming device. The frozen forming device includes a set of tool (not labelled, but shown in FIGS. 1-3, respectively); the tool includes a punch 33, a die 31, a blank holder 32; the die 31 is disposed at a lower portion of the tool; the blank holder 32 is disposed at a middle portion of the tool; and the die 33 is disposed at an upper portion of the tool and is used for applying pressure to the aluminum alloy tailor-welded plate 4 so as to facilitate the forming of the aluminum alloy tailor-welded plate 4. Moreover, a first thermal insulation layer 61 and a second thermal insulation layer 62 are disposed in the tool so as to reduce cold/thermal exchange or cold/thermal conduction between the tool and the outside, thus avoiding loss of refrigeration capacity, and improving the cooling effect of the tool. Moreover, a groove 35 is reserved at a contact surface of the tool and the aluminum alloy tailor-welded plate 4, and is used for storing ice, thus can be also called an ice groove. Moreover, a cooling chamber 34 is disposed in a portion of the tool, disposed at below the weld zone 42 of the aluminum alloy tailor-welded plate 4, of the die 31, and is used for cooling.

The frozen forming device further includes a first temperature sensor 51, a second temperature sensor 52, a cryogenic fluid medium storage tank 2 and a control device (not labeled); the first temperature sensor 51 and the second temperature sensor 52 are used for monitoring the temperature of the weld zone 42 and the temperature of the base metal zone 41, respectively; the cryogenic fluid medium storage tank 2 is used for storing the cryogenic fluid medium; the control device includes a first control valve 11 and a second control valve 12 which are connected with the cryogenic fluid medium storage tank 2 and the cooling chamber 34, respectively, and used for regulating a flow of the cryogenic fluid medium to further control the temperature of the cooling chamber 34.

As a preferred embodiment, a cooling channel 8 is disposed in the tool and the cooling channel 8 is disposed below the aluminum alloy tailor-welded plate 4, so that the cryogenic fluid medium is prevented from being in direct contact with the aluminum alloy tailor-welded plate 4, evaporation and loss of the cryogenic fluid medium are reduced, and the cryogenic fluid medium can be recycled in the (sealed) cooling channel 8 conveniently.

Example 1

Figure 2:
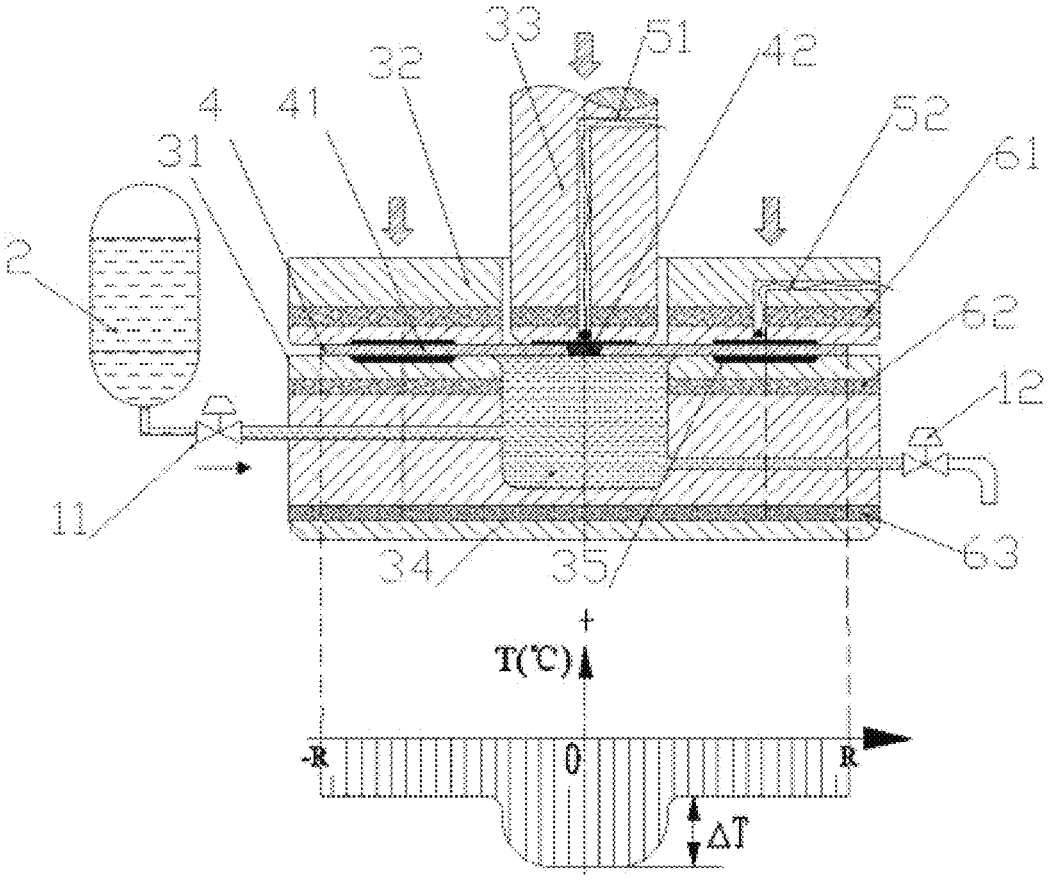
FIG. 2 is a schematic diagram of initial status/setup of frozen forming for a flat-bottom cylindrical component using the aluminum alloy FSW tailor-welded plate in embodiment of Example 1 of the present invention.
Figure 3:
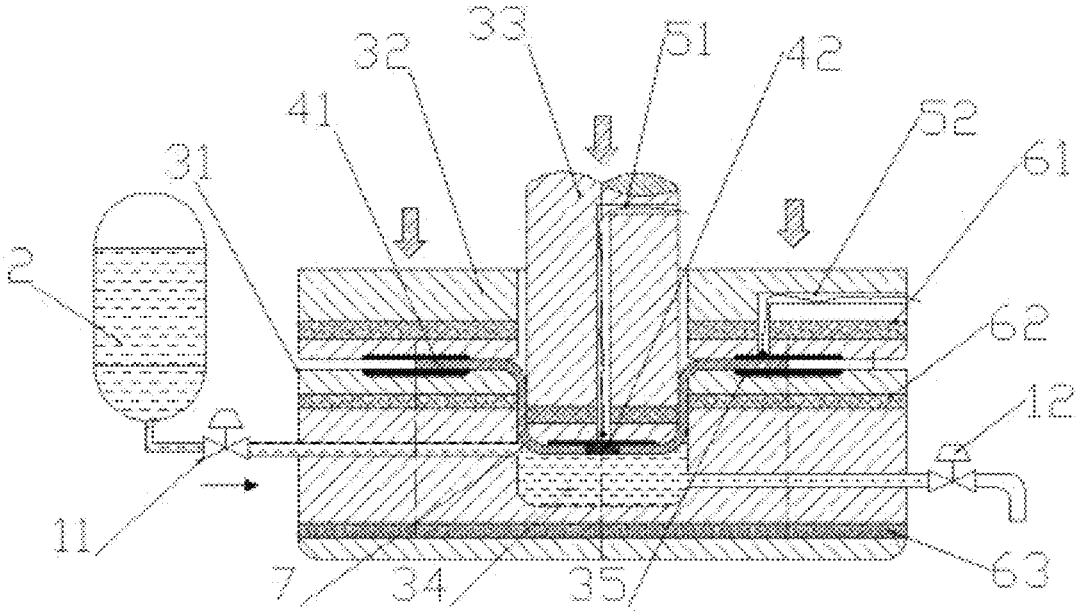
FIG. 3 is a schematic diagram of final status of frozen forming for a flat-bottom cylindrical component using the aluminum alloy FSW tailor-welded plate in Example 1 of the present invention.
Figure 4:
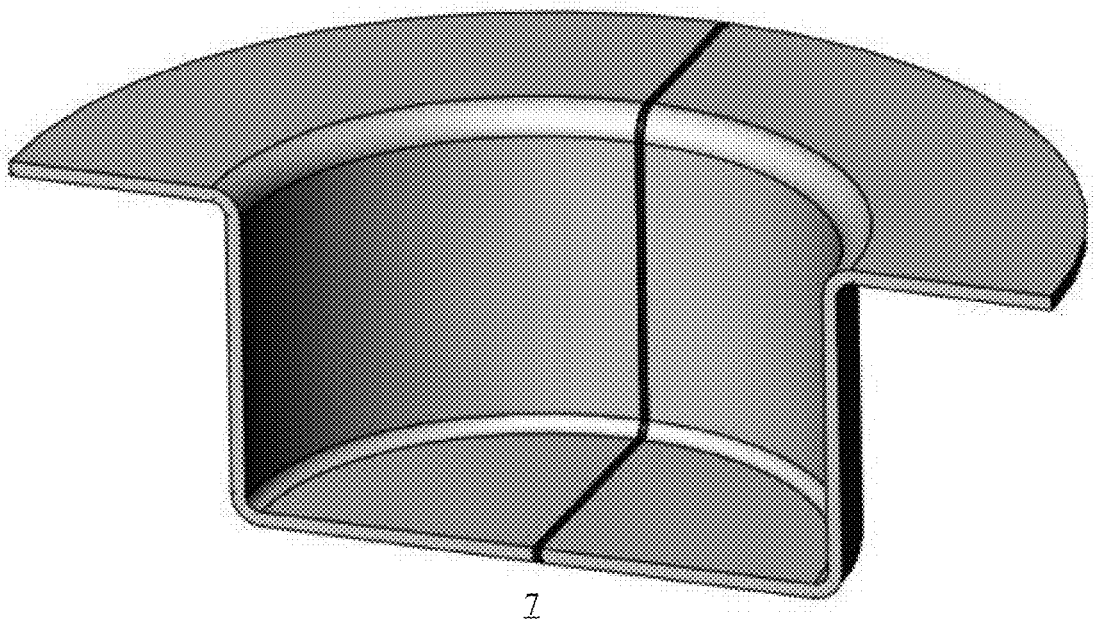
FIG. 4 is a schematic diagram of a flat-bottom cylindrical component structure by frozen forming using the aluminum alloy FSW tailor-welded plate in Example 1 of the present invention.

Please refer to FIG. 2, FIG. 3 and FIG. 4. FIG. 2 is a schematic diagram of initial status/setup of frozen forming for a flat-bottom cylindrical component 7 using the aluminum alloy (FSW) tailor-welded plate 4 in this illustrated example 1; For the sake of simplicity, the tailor-welded flat bottom cylindrical component 7 is also called the aluminum alloy tailor-welded component 7 and the flat-bottom cylindrical component 7 in the following descriptions. FIG. 3 is a schematic diagram of final status of frozen forming method for the flat-bottom cylindrical component 7 using the aluminum alloy (FSW) tailor-welded plate 4 in this example 1; FIG. 4 shows a flat-bottom cylindrical component 7 fabricated by frozen forming using the aluminum alloy FSW tailor-welded plate 4 in this example 1; The example 1 provides a freeze-forming method for a flat-bottom cylindrical component 7 using the aluminum alloy FSW tailor-welded plate 4 which is of a large-size, wherein an aluminum alloy plate is an Al—Cu—Mn alloy, and particularly an annealing status 2219 aluminum alloy tailor-welded plate with a thickness of 6 mm. Parameters for friction stir welding performed on the aluminum alloy plate are as follows: the welding advancing speed is 300 mm/min and the welding rotating speed is 800 rpm; and the diameter of a circular blank is 2700 mm and one weld joint is located at a symmetric axis of the aluminum alloy plate. A flat-bottom cylindrical rigid tool with the diameter of 2250 mm is adopted, and includes a die 33, a punch 31 and a blank holder 32, wherein a cooling chamber 34 is preset in the die 31. The additional/further specific steps for the frozen forming process while above friction stir welding process is also performed on the aluminum alloy plate are as follows:

step 1, placing the 2219 aluminum alloy tailor-welded plate 4 onto the tool and allowing a weld zone 42 to be located above the cooling chamber 34 of the die;

step 2, filling the cooling chamber 34 of the die with the cryogenic fluid medium so that the temperature of the cooling chamber 34 of the die drops to −150 degrees Celsius;

step 3, assembling the blank holder 32 and the punch 33, allowing the blank holder 32 to apply pressure of 3 MPa, regulating the flow of the cryogenic fluid medium through the first control valve 11 and the second control valve 12, and allowing the punch 33 to descend to apply drawing force to deform the 2219 aluminum alloy tailor-welded plate 4 when the temperature of the weld zone 42 of the 2219 aluminum alloy tailor-welded plate 4 reaches −150 degrees Celsius and the temperature of the base metal zone 41 is higher than −120 degrees Celsius, thereby forming a flat-bottom cylindrical component 7 using the 2219 aluminum alloy tailor-welded plate 4; and step 4, separating the punch 33, the blank holder 32 and the die 31, and taking out the flat-bottom cylindrical component 7 deformed using the 2219 aluminum alloy tailor-welded plate 4, thereby completing the frozen forming process of the 2219 aluminum alloy tailor-welded plate (that is also prepared by a concurrent friction stir welding process) for fabricating a flat-bottom cylindrical component 7. The cryogenic fluid medium is a very low temperature cooling medium, and is either liquid nitrogen or liquid helium.

By utilizing the feature that the plasticity and the strength of the weld zone are higher than the plasticity and the strength of the base metal zone caused by temperature difference on the aluminum alloy tailor-welded plate, the aluminum alloy tailor-welded plate can be deformed at a very low temperature. So, the cracking problem caused by a high degree of deformation in the weld zone can be avoided; the flat-bottom cylindrical component formed using the aluminum alloy tailor-welded plate in the example 1 can avoid microstructure damage and restore to original microstructure status after being formed, the mechanical property of the flat-bottom cylindrical component is basically not changed by the forming at the very low cryogenic temperature range. In the example 1 of freeze-forming process of the flat-bottom cylindrical component with aluminum alloy tailor-welded plate, frozen lubricating layers are formed at working surfaces between the tailor-welded plate and the tool, which can reduce friction force during flowing of the blank while the performing the FSW process, thereby reducing forming force, and greatly reducing the tonnage and cost of forming equipment.

Example 2

This example provides a frozen forming method for a flat-bottom cylindrical component structure, also referred to as flat-bottom cylindrical component herein below, using an aluminum alloy FSW tailor-welded plate, and differs from Example 1 in that the aluminum alloy plate is an Al—Cu—Mg alloy, and particularly an annealing status 2024 aluminum alloy tailor-welded plate with a thickness of 7 mm. Parameters for friction stir welding performed on the aluminum alloy plate are as follows: the welding advancing speed is 200 mm/min and the welding rotating speed is 1000 rpm; and the diameter of a circular blank is 2700 mm and one weld joint is located at a symmetric axis of the aluminum alloy plate. A flat-bottom cylindrical rigid tool with the diameter of 2250 mm is adopted, and includes a punch 33, a die 31 and a blank holder 32, wherein a cooling chamber 34 is preset in the die 31. The further specific steps for the frozen forming process of example 2 are as follows: step 1, placing the 2024 aluminum alloy tailor-welded plate 4 onto the tool and allowing a weld zone 42 to be located above the cooling chamber 34 of the die; step 2, filling the cooling chamber 34 of the die with a cryogenic fluid medium so that the temperature of the cooling chamber 34 of the die drops to −172 degrees Celsius; step 3, assembling the blank holder 32 and the punch 33, allowing the blank holder 32 to apply 3 MPa pressure, regulating the flow of the cryogenic fluid medium through the first control valve 11 and the second control valve 12, and allowing the punch 33 to descend to apply drawing force to deform the 2024 aluminum alloy tailor-welded plate 4 when the temperature of the weld zone 42 of the 2024 aluminum alloy tailor-welded plate 4 reaches −172 degrees Celsius and the temperature of the base metal zone 41 is higher than −142 degrees Celsius, thereby forming a flat-bottom cylindrical component 7 using the 2024 aluminum alloy tailor-welded plate 4; and step 4, separating the punch 33, the blank holder 32 and the die 31, and taking out the flat-bottom cylindrical component 7, thereby completing frozen forming of the flat-bottom cylindrical component 7 of the 2024 aluminum alloy tailor-welded plate 4. The cryogenic fluid medium is a very low temperature cooling medium, and is either liquid nitrogen or liquid helium, for example.

By utilizing the feature that the plasticity and the strength of the weld zone are higher than the plasticity and the strength of the base metal zone caused by temperature difference on the aluminum alloy tailor-welded plate, the cracking problem caused by a high degree of deformation in the weld zone can be avoided. The flat-bottom cylindrical component of aluminum alloy tailor-welded plate formed in the example can avoid microstructure damage and restore to original microstructure status after being formed, the microstructure and mechanical property are basically not changed by the forming at the very low temperature; and in the example of frozen forming process for flat-bottom cylindrical component with the aluminum alloy tailor-welded plate, frozen lubricating layers are formed at working surfaces between the tailor-welded plate and the tool, which can reduce frictional force during flowing of the blank, reduce forming force, and greatly reduce the tonnage and cost of forming equipment.

Example 3

Figure 5:
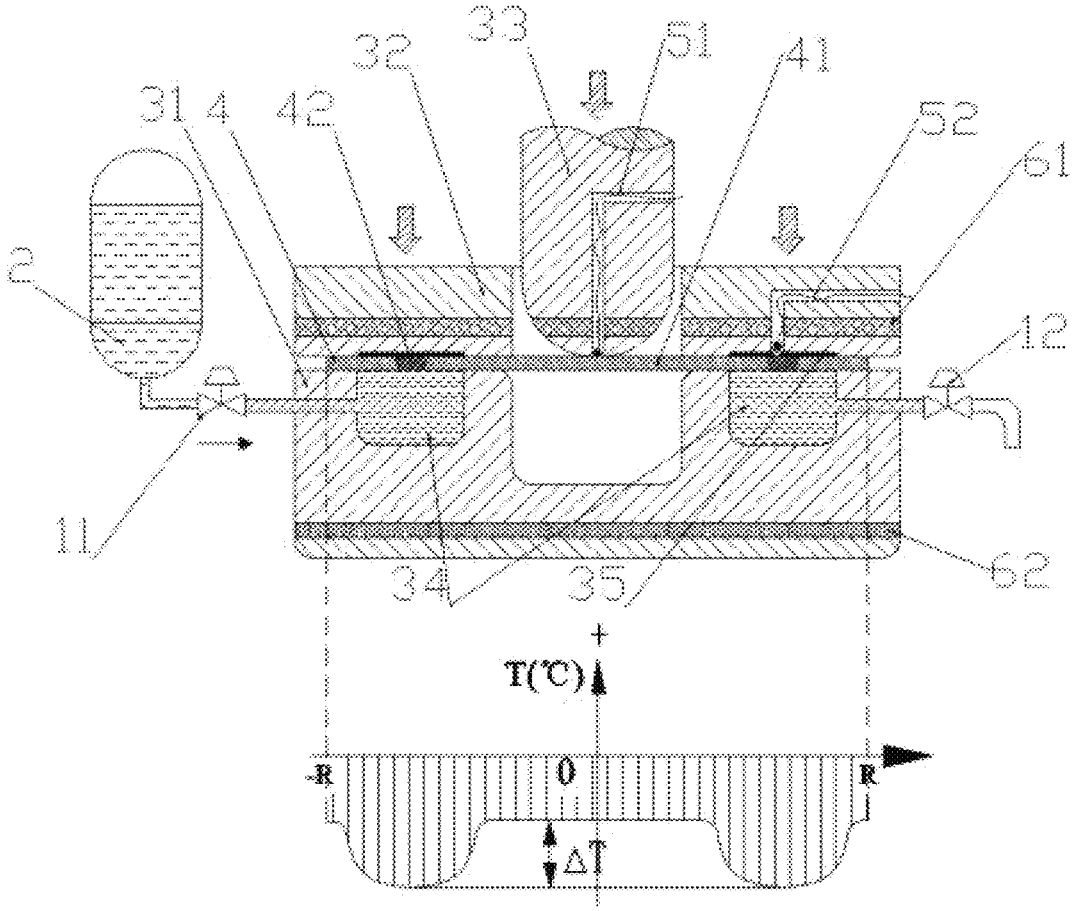
FIG. 5 is a schematic diagram of initial status/step of frozen forming for a hemispherical component using an aluminum alloy FSW tailor-welded plate in Example 3 of the present invention.
Figure 6:
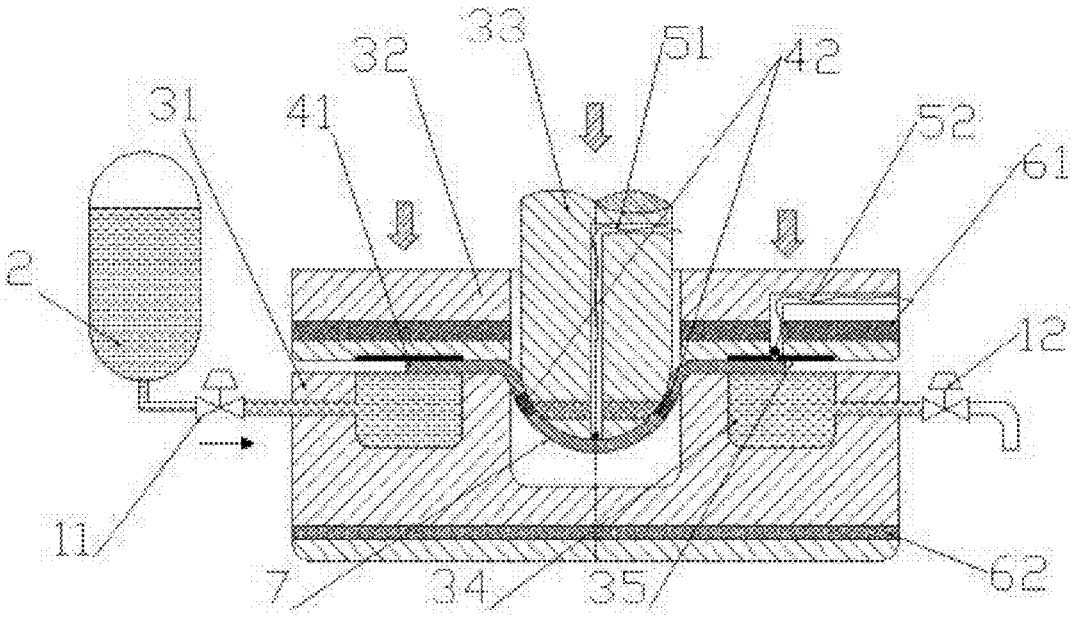
FIG. 6 is a schematic diagram of final status of frozen forming for the hemispherical component structure using the aluminum alloy FSW tailor-welded plate in Example 3 of the present invention.
Figure 7:
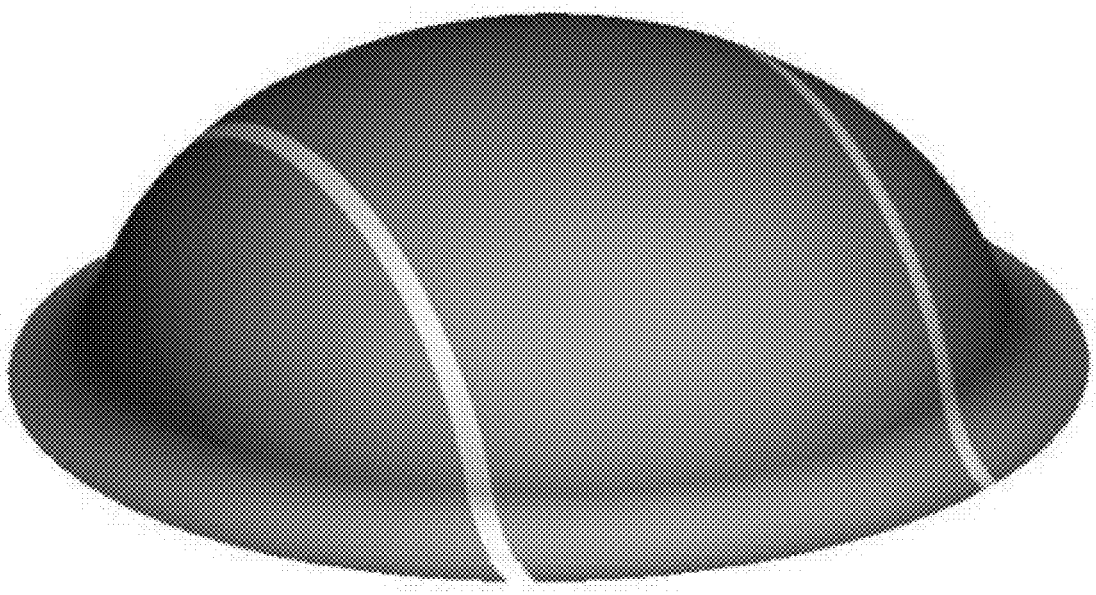
FIG. 7 is a hemispherical component structure diagram by frozen forming using the aluminum alloy FSW tailor-welded plate in Example 3 of the present invention.

Please refer to FIG. 5, FIG. 6 and FIG. 7. FIG. 5 is a schematic diagram of initial status of frozen forming for a hemispherical (aluminum alloy tailor-welded) component 7 using an aluminum alloy FSW tailor-welded plate in Example 4 of the present invention; FIG. 6 is a schematic diagram of final status of frozen forming for the hemispherical (aluminum alloy tailor-welded) component 7 using the aluminum alloy FSW tailor-welded plate in Example 4 of the present invention; FIG. 7 shows a hemispherical (aluminum alloy tailor-welded) component 7 fabricated by frozen forming using the aluminum alloy FSW tailor-welded plate in Example 4 of the present invention The example 3 provides a frozen forming method for a hemispherical component using an aluminum alloy FSW tailor-welded plate, wherein an aluminum alloy plate is an Al—Cu—Mn alloy, and particularly an annealing status 2219 aluminum alloy tailor-welded plate with the thickness of 8 mm. Parameters for friction stir welding performed on the aluminum alloy plate are as follows: the welding advancing speed is 300 mm/min and the welding rotating speed is 800 rpm; the diameter of a circular blank is 4200 mm; two weld joints are located at two sides, 1750 mm far away from a symmetric axis of the blank respectively; and a semi-ellipsoidal rigid tool with the diameter of 3350 mm is adopted, and includes a punch 33, a die 31 and a blank holder 32, wherein cooling chambers 34 are preset in the die 31. The further specific steps for frozen forming method for example 3 are as follows:

step 1, conducting solution treatment on the aluminum alloy tailor-welded plate 4, heating a solid solution to 535 degrees Celsius by a box type heating furnace, placing in the aluminum alloy tailor-welded plate 4 for heat preservation for 45 minutes, then taking the aluminum alloy tailor-welded plate 4 out and conducting rapid water quenching on the aluminum alloy tailor-welded plate 4;

step 2, placing the 2219 aluminum alloy tailor-welded plate 4 onto the tool and allowing weld zones 42 to be located above the cooling chambers 34 of the die;

step 3, filling the cooling chambers 34 of the die with the cryogenic fluid medium so that the temperatures of the cooling chambers 34 of the die drop to −180 degrees Celsius;

step 4, assembling the blank holder 32 and the punch 33, allowing the blank holder 32 to apply pressure of 3 MPa, regulating the flow of the cryogenic fluid medium through the first control valve 11 and the second control valve 12, and allowing the punch 33 to descend to apply drawing force to deform the 2219 aluminum alloy tailor-welded plate 4 when the temperatures of the weld zones 42 of the 2219 aluminum alloy tailor-welded plate 4 reach −180 degrees Celsius and the temperature of the base metal zone 41 is higher than −150 degrees Celsius, thereby forming a hemispherical (aluminum alloy tailor-welded) component 7 using the 2219 aluminum alloy tailor-welded plate 4;

step 5, separating the punch 33, the blank holder 32 and the die 31, and taking out the hemispheric component 7, thereby completing frozen forming of hemispheric component 7 with the 2219 aluminum alloy tailor-welded plate 4; and step 6, conducting artificial aging treatment on the (thin-walled) hemispherical component 7, placing the hemispherical component 7 in an aging furnace for heat preservation at 175 degrees Celsius for 18 hours, then taking the hemispherical component 7 out, and air cooling the hemispherical component to the room temperature. The cryogenic fluid medium is a very low temperature cooling medium, and is either liquid nitrogen or liquid helium.

By utilizing the feature that the plasticity and the strength of the weld zone are higher than the plasticity and the strength of the base metal zone caused by temperature difference on aluminum alloy tailor-welded plate at a very low temperature, the cracking problem caused by high degrees of deformation in the weld zones can be avoided and restore to original microstructure status after being formed. The aluminum alloy tailor-welded plate hemispheric component formed in the example can avoid microstructure damage and restore to original microstructure status after being formed, the microstructure and mechanical property are basically not changed by the forming at the very low temperature. In the example of the freeze-forming process of the hemispheric component, frozen lubricating layers are formed at working surfaces between the tailor-welded plate and the tool, which can reduce friction force during flowing of the blank, reduce forming force, and greatly reduce the tonnage and cost of forming equipment.

Example 4

This example provides a frozen forming method for a hemispherical shaped component (structure) fabricated from an aluminum alloy FSW tailor-welded plate, and differs from Example 3 in that wherein an aluminum alloy plate is an Al—Mg—Si alloy, and particularly a quenching status 6016 aluminum alloy tailor-welded plate with the thickness of 6 mm. Parameters for friction stir welding performed on the aluminum alloy plate are as follows: the welding advancing speed is 400 mm/min and the welding rotating speed is 1200 rpm; the diameter of a circular slab is 4200 mm; two weld joints are located at two sides, 1750 mm far away from a symmetric axis of the slab respectively; and a semi-ellipsoidal rigid tool with the diameter of 3350 mm is adopted, and includes a punch 33, a die 31 and a blank holder 32, wherein a plurality of cooling chambers 34 are preset in the die 31. The further specific steps for frozen forming method in example 4 are as follows: step 1, placing the 6016 aluminum alloy tailor-welded plate 4 onto the tool and allowing weld zones 42 to be located above the cooling chambers 34 of the die;

step 3, filling the cooling chambers 34 of the die with the cryogenic fluid medium so that the temperatures of the cooling chambers 34 of the die drop to −160 degrees Celsius; step 4, assembling the blank holder 32 and the punch 33, allowing the blank holder 32 to apply pressure of 3 MPa, regulating the flow of the cryogenic fluid medium through the first control valve 11 and the second control valve 12, and allowing the punch 33 to descend to apply drawing force to deform the 6016 aluminum alloy tailor-welded plate 4 when the temperatures of the weld zones 42 of the 6016 aluminum alloy tailor-welded plate 4 reach −160 degrees Celsius and the temperature of the base metal zone 41 is higher than −130 degrees Celsius, thereby forming a 6016 aluminum alloy tailor-welded plate hemispherical component; step 5, separating the punch 33, the blank holder 32 and the die 31, and taking out the hemispherical component, thereby completing the frozen forming of the hemispherical component 7; and step 6, conducting artificial aging treatment on the (thin-walled) hemispherical component 7, and placing the hemispherical component 7 in an aging furnace for heat preservation at 175 degrees Celsius for 20 minutes, then taking the hemispherical component 7 out and air cooling the hemispherical component 7 to the room temperature. The cryogenic fluid medium is a very low temperature cooling medium, and is either liquid nitrogen or liquid helium.

By utilizing the feature that the plasticity and the strength of the weld zone are higher than the plasticity and the strength of the base metal zone, caused by temperature difference on aluminum alloy tailor-welded plate at a very low temperature, the cracking problem caused by high degrees of deformation in the weld zones can be avoided and restore to original microstructure status after being formed. The hemispheric component formed using aluminum alloy tailor-welded plate in the example can avoid internal microstructure damage, the structure property is basically not changed by the forming at the very low temperature. In the example of the freeze-forming process of hemispheric component with the aluminum alloy tailor-welded plate, frozen lubricating layers are formed at working surfaces between the tailor-welded plate and the tool, which can reduce frictional resistance during flowing of the blank, reduce forming force, and greatly reduce the tonnage and cost of forming equipment.

Example 5

Figure 8:
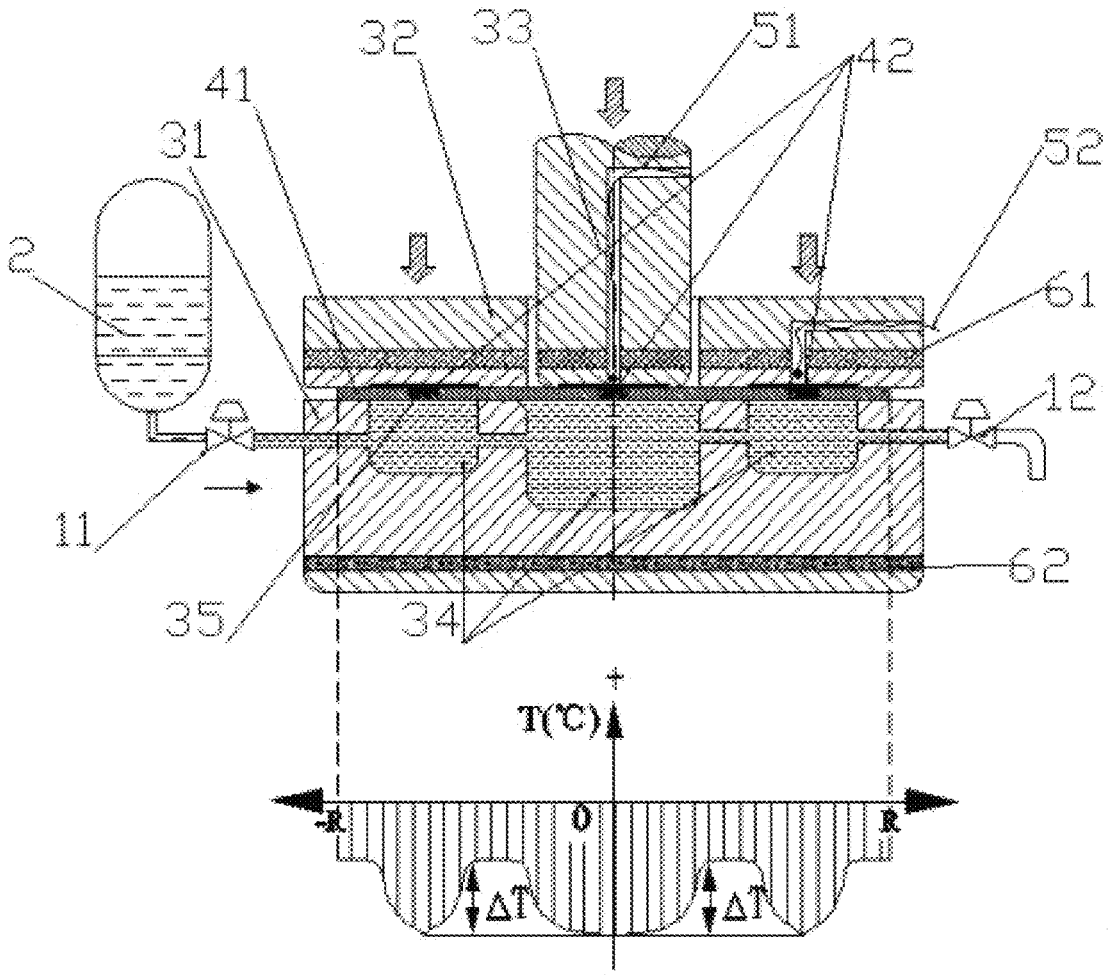
FIG. 8 is a schematic diagram of initial status of frozen forming for a U-shaped component using an aluminum alloy FSW tailor-welded plate in Example 5 of the present invention.
Figure 9:
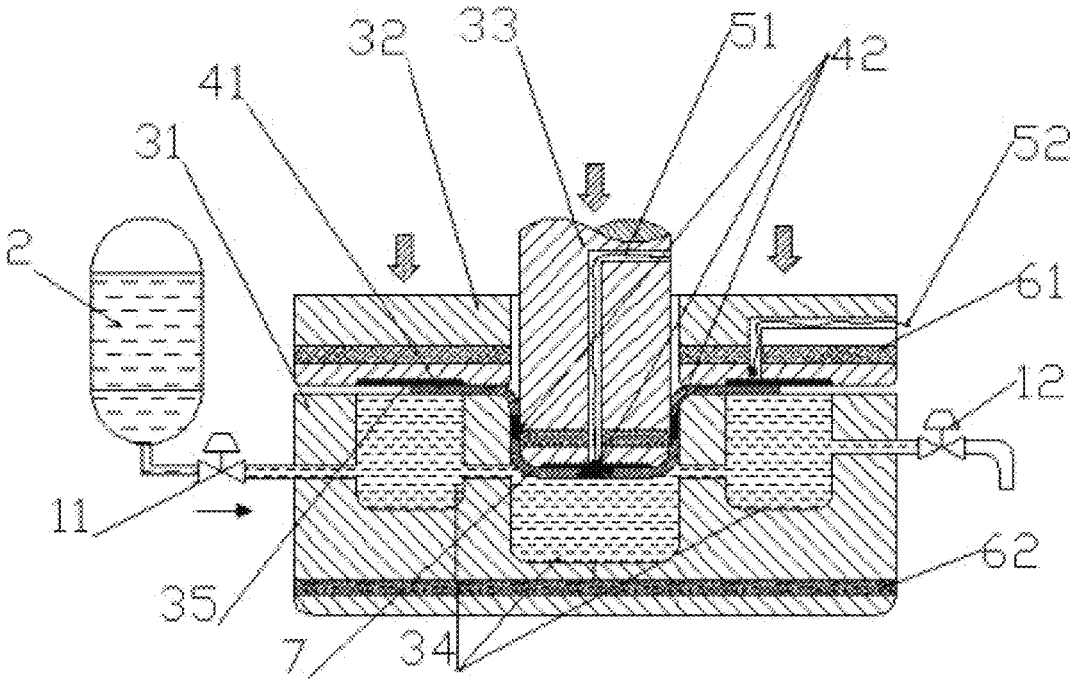
FIG. 9 is a schematic diagram of final status of frozen forming for a U-shaped component using the aluminum alloy FSW tailor-welded plate in Example 5 of the present invention.
Figure 10:
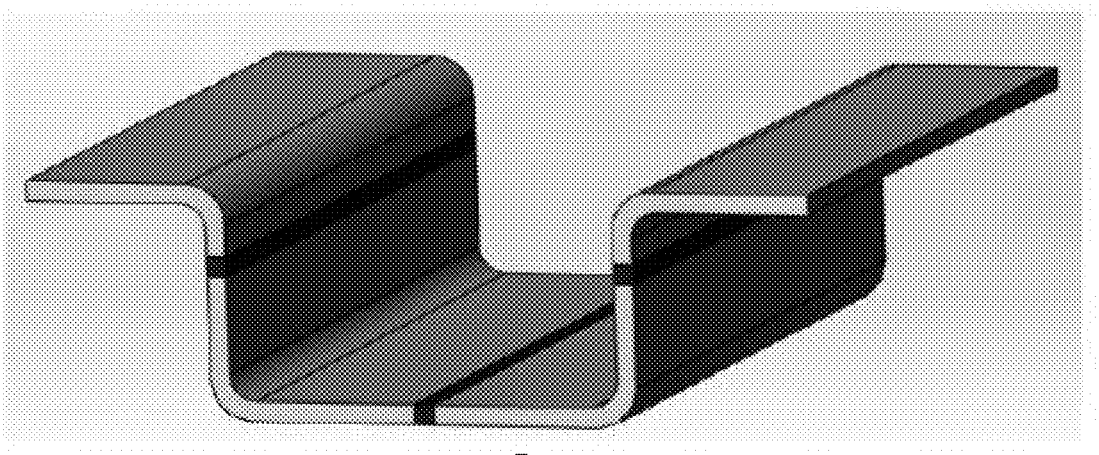
FIG. 10 is an U-shaped component structure fabricated by frozen forming using the aluminum alloy FSW tailor-welded plate in Example 5 of the present invention.

Please refer to FIG. 8, FIG. 9 and FIG. 10 for illustrating of Example 5. FIG. 8 is a schematic diagram of initial status of frozen forming for an U-shaped component with an aluminum alloy FSW tailor-welded plate in this example; FIG. 9 is a schematic diagram of final status of frozen forming for an U-shaped component with the aluminum alloy FSW tailor-welded plate in this example; FIG. 10 is an U-shaped component structure diagram of freeze-forming of the aluminum alloy FSW tailor-welded plate in this example. The example provides a frozen forming method of an U-shaped component with an aluminum alloy FSW tailor-welded plate, wherein an aluminum alloy plate is an Al—Cu—Li alloy, and particularly an annealing status 2195 aluminum alloy tailor-welded plate with the thickness of 2 mm. Parameters for friction stir welding are as follows: the welding advancing speed is 200 mm/min and the welding rotating speed is 1000 rpm; the size of a rectangular slab is 1200 mm (L)×600 mm (W); three weld joints are respectively located at a center of a symmetric axis in the width direction of the blank, and at two sides, 200 mm far away from the symmetric axis; and a rigid tool with the length, width and height of 1200 mm, 300 mm and 300 mm respectively is adopted, and includes a punch 33, a die 31 and a blank holder 32, wherein cooling chambers 34 are preset in the die 31. The further specific steps for example 5 are as follows:

step 1, placing the 2195 aluminum alloy tailor-welded plate 4 onto the tool and allowing weld zones 42 to be located above the cooling chambers 3-4 of the die; step 2, filling the cooling chambers 34 of the die with the cryogenic fluid medium so that the temperatures of the cooling chambers 34 of the die drop to −196 degrees Celsius;

step 3, assembling the blank holder 32 and the punch 33, allowing the blank holder 32 to apply pressure of 3 MPa, regulating the flow of the cryogenic fluid medium through the first control valve 11 and the second control valve 12, and allowing the punch 33 to descend to apply drawing force to deform the 2195 aluminum alloy tailor-welded plate 4 when the temperatures of the weld zones 42 of the 2195 aluminum alloy tailor-welded plate 4 reach −196 degrees Celsius and the temperature of the base metal zone 41 is higher than −150 degrees Celsius, thereby forming an U-shaped component with 2195 aluminum alloy tailor-welded plate; and step 4, separating the punch 33, the blank holder 32 and the die 31, and taking out the U-shaped component, thereby completing frozen forming of the U-shaped component 7. The cryogenic fluid medium is a very low temperature cooling medium, and is either liquid nitrogen or liquid helium.

By utilizing the feature that the plasticity and the strength of the weld zone are higher than the plasticity and the strength of the base metal zone caused by temperature difference on aluminum alloy tailor-welded plate at a very low temperature, the cracking problem caused by high degrees of deformation in the weld zones can be avoided and restore to original microstructure status after being formed. The U-shaped component formed using aluminum alloy tailor-welded plate in the example can avoid microstructure damage, the microstructure and mechanical property are basically not changed by the forming at the very low temperature. In the example of the frozen forming process of U-shaped component with the aluminum alloy tailor-welded plate, frozen lubricating layers are formed at working surfaces between the tailor-welded plate and the tool, which can reduce frictional resistance during flowing of the blank, reduce forming force, and greatly reduce the tonnage and cost of forming equipment.

Example 6

This example provides a frozen forming method for a flat-bottom cylindrical component with aluminum alloy FSW tailor-welded plate, and differs from Example 1 in that the aluminum alloy plate is an Al—Zn—Mg—Cu alloy, and particularly an aging status 7075 aluminum alloy tailor-welded plate with the thickness of 6.5 mm. Parameters for friction stir welding are as follows: the welding advancing speed is 300 mm/min and the welding rotating speed is 800 rpm; and the diameter of a circular blank is 2700 mm and one weld joint is located at a symmetric axis of the blank; and a flat-bottom cylindrical rigid tool with the diameter of 2250 mm is adopted, and includes a punch 33, a die 31 and a blank holder 32, wherein a cooling chamber 34 is preset in the die 31. The further specific steps are as follows:

step 1, placing the 7075 aluminum alloy tailor-welded plate 4 onto the tool and allowing a weld zone 42 to be located above the cooling chamber 34 of the die;

step 2, filling the cooling chamber 34 of the die with the cryogenic fluid medium so that the temperature of the cooling chamber 34 of the die drops to −180 degrees Celsius;

step 3, assembling the blank holder 32 and the punch 33, allowing the blank holder 32 to apply pressure of 3 MPa, regulating the flow of the cryogenic fluid medium through the first control valve 11 and the second control valve 12, and allowing the punch 33 to descend to apply drawing force to deform the 7075 aluminum alloy tailor-welded plate 4 when the temperature of the weld zone 42 of the 7075 aluminum alloy tailor-welded plate 4 reaches −180 degrees Celsius and the temperature of the base metal zone 41 is higher than −150 degrees Celsius, thereby forming a 7075 aluminum alloy tailor-welded plate flat-bottom cylindrical component; and step 4, separating the punch 33, the blank holder 32 and the die 31, and taking out the 7075 aluminum alloy tailor-welded plate flat-bottom cylindrical component, thereby completing frozen forming of the 7075 aluminum alloy tailor-welded plate flat-bottom cylindrical component 7. The cryogenic fluid medium is a very low temperature cooling medium, and is either liquid nitrogen or liquid helium.

By utilizing the feature that the plasticity and the strength of the weld zone are higher than the plasticity and the strength of the base metal zone caused by temperature difference on aluminum alloy tailor-welded plate at a very low temperature, the cracking problem caused by a high degree of deformation in the weld zone can be avoided and restore to original microstructure status after being formed. The U-shaped component formed using the aluminum alloy tailor-welded plate in the example can avoid microstructure damage, the microstructure and mechanical property are basically not changed by the forming at the very low temperature. In this example the frozen forming process of U-shaped component with the aluminum alloy tailor-welded plate, frozen lubricating layers are formed at working surfaces between the tailor-welded plate and the tool, which can reduce friction force during flowing of the blank, reduce forming force, and greatly reduce the tonnage and cost of forming equipment.

In the above examples, the fabricated different shaped component structures or components can be classified as being of thin wall and large size based on the specific thickness and diameter values, respectively.

Although the invention is described in detail in combination with the above examples, those of ordinary skill in the art shall understood that they can modify technical schemes documented in the above examples or perform equivalent replacement on some technical features, and any modification, equivalent replacement, improvement and the like made within the spirit and rule of the invention shall be incorporated in the protection scope of the invention.

What is claimed is:

1. A frozen forming method for an aluminum alloy component, comprising:

cooling an aluminum alloy tailor-welded plate with a cryogenic fluid medium, and forming the aluminum alloy plate into a complex shape component by a tool, and the frozen forming method further comprising the steps of:

step 1, placing the aluminum alloy tailor-welded plate onto the tool;

step 2, assembling the tool and filling the tool with the cryogenic fluid medium so that the temperature of the tool drops to −150 degrees Celsius to −196 degrees Celsius;

step 3, deforming the aluminum alloy tailor-welded plate by applying pressure with the tool when the temperature of a weld zone of the aluminum alloy tailor-welded plate reaches −150 degrees Celsius to −196 degrees Celsius and is lower than the temperature of a base metal zone, that is a temperature difference delta T occurs between the weld zone and the base metal zone, thereby forming the aluminum alloy tailor-welded plate to a designed shape of the aluminum alloy component; and step 4, disassembling the tool, and taking out the aluminum alloy component.

2. The frozen forming method for the aluminum alloy component structure of claim 1, wherein in the step 3 the temperature difference between the weld zone and the base metal zone is not less than 30 degrees Celsius.

3. The frozen forming method for the aluminum alloy component of claim 2, wherein the aluminum alloy tailor-welded plate is one of an Al—Cu—Mg alloy plate, an Al—Cu—Mn alloy plate, an Al—Mg—Si alloy plate, an Al—Zn—Mg—Cu alloy plate and an Al—Cu—Li alloy plate.

4. The frozen forming method for the aluminum alloy component of claim 2, wherein the aluminum alloy tailor-welded plate is prepared by friction stir welding technology.

5. The frozen forming method for the aluminum alloy component of claim 4, wherein the cryogenic fluid medium is a cooling medium for cryogenic temperature, and is either liquid nitrogen or liquid helium.

6. The frozen forming method for the aluminum alloy component of claim 1, wherein a solution treatment is conducted on the aluminum alloy tailor-welded plate before the step 1, and an artificial aging treatment is conducted on the aluminum alloy component after the step 4.

7. The frozen forming method for the aluminum alloy component claim 1, wherein the tool comprises at least one cooling chamber, and the cooling chamber is disposed as a portion of the tool, where the weld zone is located, and is used for cooling.

8. The frozen forming method for the aluminum alloy component claim 7, wherein in the step 2, the temperature of the tool is regulated via a control device, and the control device is connected with the cooling chamber, and further controlling of the temperature of the cooling chamber is by regulating the flow of the cryogenic fluid medium.

9. The frozen forming method for the aluminum alloy component of claim 8, wherein the tool is further provided with a thermal insulating layer.

10. The frozen forming method for the aluminum alloy component of claim 9, wherein the tool is provided with a cooling channel, and the cooling channel is disposed as a portion of the tool, where the weld zone of the aluminum alloy tailor-welded plate is located.

11. The frozen forming method for the aluminum alloy component of claim 4, wherein the aluminum alloy tailor-welded plate having a thickness of between 2 mm to 8 mm, and made from an aluminum alloy plate having a diameter of 2700 mm to 4200 mm.

* * * * *